United States Patent [19]

Bernstein

[11] 4,051,295

[45] Sept. 27, 1977

[54] ALTERATION-SENSITIVE SURFACE

[76] Inventor: Donald J. Bernstein, 2 Grover Terrace, Fairlawn, N.J. 07410

[21] Appl. No.: 534,726

[22] Filed: Dec. 20, 1974

[51] Int. Cl.[2] ..... B42D 15/02

[52] U.S. Cl. ..... 428/288; 283/8 B; 283/9 R; 427/7; 427/336; 428/206; 428/207; 428/296; 428/409; 428/916

[58] Field of Search ..... 427/335, 336, 301, 299, 427/7; 428/195, 196, 265, 288, 206, 207, 409, 916, 296; 8/130.1, 175, 174, 94 A, 180; 283/8 B, 9 R; 40/2.2

[56] References Cited

U.S. PATENT DOCUMENTS

| | | | |
|---|---|---|---|
| 2,260,543 | 10/1941 | Smith | 8/180 |
| 2,829,118 | 4/1958 | Wehr | 8/180 |
| 3,046,076 | 7/1962 | Upshur | 8/180 |
| 3,367,150 | 2/1968 | Smith et al. | 8/94 A |
| 3,502,495 | 3/1970 | Akamatsu | 106/32 |
| 3,512,913 | 5/1970 | Day et al. | 8/94 A |
| 3,644,080 | 2/1972 | McCullough | 8/174 |

*Primary Examiner*—James J. Bell

*Attorney, Agent, or Firm*—Lackenbach, Lilling & Siegel

[57] ABSTRACT

This invention provides an article having an alteration-sensitive surface, generally a sheet material formed of spun continuous strands of fine interconnected fibres of polyolefin, which are bonded together with heat and pressure. The surface of the sheet material is degraded by utilizing solvents, prior to imprinting desired information onto the surface, the surface then being easily abraded so as to substantially prevent alteration without permanently changing the appearance of the surface. Preferably, the surface of the sheet material is overall coated, or imprinted, with a contrasting color such that by abrading the surface the imprint is erased and the white or other natural color of the olefin fibres appears, thus increasing the visibility of the abraded surface.

11 Claims, No Drawings

ALTERATION-SENSITIVE SURFACE

An alteration-sensitive sheet, card, or the like, is provided, which can be readily prepared in high volume and at low cost, but which is difficult to alter without also making an irreversible change in the appearance of the surface of the article.

In this modern age of high speed and long-distance travel and commerce, business documents, including traditional negotiable instruments such as stocks and bonds, as well as personal checks, letters of credit, credit cards, all require that the individual utilizing or attempting to cash the instruments be identified and that the identification be as secure as possible in order to product the party paying on the instrument. Security of this type is extremely important in order to maintain the easy flow of international commerce.

Various concepts have been tried out in order to obtain the desired security; for example various types of identification cards, which can be carried on the person for particular purposes, have been provided. There have been problems, however, which render each type of identification card less than completely useful. For example, one type of identification card, the type often used for identification of employees in industrial establishments, or of, for example, United States Armed Forces personnel, comprises a multi-ply, laminated card having a printed paper card as the center or core of the sandwich, to which there is often attached a photograph, thumb print, signature and/or other means of personal identification. Although the basic card can, only with difficulty, be altered, for example, by separating the lamination, major drawbacks of this type of identification card are the expense and the fact that each card must be custom made; therefore this card is not suitable for such mass distribution uses as telephone credit cards, automobile licenses, health plan identification cards, credit card uses, or identification for travellers checks. An improved type of this identification card is shown, for example, in U.S. Pat. No. 3,413,171. A second and simpler type of identification card is of the type often used by banks or as telephone credit cards which often have a pantograph background. Such a background is often found not only on State driver's licenses, but, for example, on commercial paper, such as checks. Generally, in this type of card, a sheet has the erasable pantograph or other overall pattern formed thereon, and the identifying information is then typewritten thereover and the signature handwritten thereupon. Similar types of "safety paper" have also been used for various paper documents, negotiable instruments, checks, drafts, bank orders, etc. as well as for paper materials such as tax labels, as shown, for example, in U.S. Pat. Nos. 1,454,837; 1,652,042; 2,223,106; 3,008,841; 3,400,003. In this type of material, as commonly used, for example, on personal checks, a camouflaging imprint is generally formed over the surface of the check, which, when an attempt is made to erase any information imprinted or hand-written thereon, is itself erased to expose a voiding imprint, for example, the word "VOID".

An attempt has been made to form a more durable article out of plastic, particularly in the case of negotiable bank notes which are intended to be reused. However, such products have been complex, difficult to manufacture, and cumbersome to use. See for example, U.S. Pat. No. 2,330,718.

A paper-like sheet material which is now commercially available is a so-called spunbonded, olefin fibre material formed by the spinning of continuous, interconnected strands of polyolefin fibres, generally high-density polyethylene fibres, which are then bonded together with heat and pressure, but without requiring the presence of any additional adhesive, sizing or bonding agent. Such materials are noted for their dimensional stability, toughness and durability because of the great strength of the continuous spun polyolefin fibre material used in their manufacture. They have been utilized in the manufacture of a great number of products, including wall coverings, maps, book covers, signs, tags, labels and envelopes. Uncoated sheet material of this type is considered to be well suited as a printing substrate and has been printed for example, utilizing conventional offset and letterpress inks as well as flexographic and gravure inks and screen process printing inks. It is known however, that certain volatile solvents result in swelling and distortion of the sheet, especially aliphatic hydrocarbon solvents. For that reason, water-based inks are considered to be especially useful for the material. The non-polar solvents have been known to swell or pucker the sheet surface in much the same manner as water on paper. The abrasion resistance of the spunbonded olefin sheet material has also been increased by coating the surfaces.

It has now been discovered, in accordance with the present invention, that attributes of the spunbonded olefin polymer fibre sheet materials which had been thought to be detrimental to their usefulness in the printing arts, can be applied to obtain a highly useful, alteration-sensitive material having a great many uses in enhancing the security of valuable documents and ensuring the accuracy and validity of means of identification.

In accordance with the present invention, there is provided a flexible sheet material formed of spunbonded fibres of thermoplastic polymers, which is extremely sensitive to alteration, so as to render obvious any alteration and thus invalidate the article for identification or other desired purposes. The alteration-sensitive surface provides a pleasing appearance which can be used as a background in the manufacture of substantially any type of sheet article, suitable, for example, for identification or commercial paper. The plastic sheet material is highly durable, highly resistant to tearing and can be readily folded without destroying the integrity of the product.

The invention provides an article comprising a flexible sheet of spunbonded thermoplastic polymer fibre, treated over a portion of at least one surface thereof to render that portion easily degraded by abrasion, wherein the abraded degradation is readily visible.

In accordance with one preferred aspect of the present invention, there is provided a sheet of spunbonded olefin polymer fibre, at least a portion of one surface having been treated with a solvent liquid having the capacity to cause swelling of the olefin polymer fibre, whereby the treated surface is rendeed permanently readily degradable by abrasion, imprinted over at least the treated portion of the surface a continuous, erasable coating of ink, substantially completely obscuring and covering at least the treated portion of the sheet surface, the coating having a substantially different or contrasting appearance than the said treated portion, and recorded information imprinted onto the erasable coating; whereby any attempt to erase and change a portion of the recorded information, abrades the treated portion and exposes the underlying sheet surface, rendering obvious that an alteration had been made. The appearance of abrasion persists subsequent to the imprinting of a further overall coating hiding the underlying sheet surface in an attempt to disguise the alteration.

In a preferred embodiment, the treatment of the surface and the imprinting of the contrasting color upon the surface can be carried out simultaneously by utilizing, for example, an ink containing a proportion of a liquid solvent sufficient to create the desired effect upon the surface of the sheet material when the ink is applied, in normal printing manner, to the surface of the sheet. Thus, for example, the overall coating can be obtained utilizing any conventional printing process such as a screen process, offset lithography, flexography, letterpress, gravure, and offset. When utilizing a screen process to apply a screen, or "tint", value, a relatively smaller concentration of ink is applied to the surface of the sheet and, in the case of a colored ink material, a non-opaque, or pastel-like, appearance is created. The percentage of the full value of the ink applied by the screen determines the intensity of the color as well as the opacity of the overall coating. Similarly, the degree of the screen value also determines the amount of solvent applied, and thus the effectiveness of the treatment to the surface of the sheet obtained by applying the ink in this manner. Accordingly, a screen value is useful alternative to a full value opaque ink coating.

The sheet material used in accordance with the present invention, is preferably a spunbonded olefin, for example of the type sold under the trademark "TYVEK" by Dupont de Nemours and Co. This material is made of a high density polyethylene fibre spun out in very fine continuous strands and interconnected and bonded together with heat and pressure, without the use of adhesives or other bonding agents. However, the invention can be carried out utilizing a sheet material formed of fibres of substantially any thermoplastic polymer which is swellable or softenable by solvent action. For example, other polymers including, for ecample acrylic polymers including polymers formed of both acrylic acid and its esters, methacrylic acid and its esters, and acrylonitrile units, could be used.

The surface of the sheet material is treated with a solvent having the power to swell and/or soften the fibres forming the spunbonded sheet material so as to permanently render the surface more easily degradable by abrasion. Generally, non-polar solvents are useful, especially hydrocarbon solvents and the inertly-substituted such hydrocarbon solvents, for example, halogenated hydrocarbon solvents. Aliphatic hydrocarbon solvents as well as aromatic hydrocarbon solvents are useful, although the aliphatic solvents are most preferred. Useful, such hydrocarbon solvents generally contain up to about 12 carbon atoms and preferably not more than about 8 carbon atoms. Useful such hyrocarbons include naphthols, petroleum ether, rubber solvent, naptha, mineral spirits, pentane, gasoline, toluene and benzene. Halogenated hydrocarbon solvents include tetrachloromethane, and fluorocarbons such as trichlorotirfluoroethane and dichlorotetrafluoroethane. The hydrocarbon solvents are generally derived from petroleum distillates and comprise the more volatile fractions, generally having boiling points below about 500° F. trichlorotrifluorethane and dichlorotetrafluoroethane. The hydrocarbon solvents are generally derived from petroleum distillates and comprise the more volatile fractions, generally having boiling points below about 500° F.

Generally, the solvents should have a sufficiently strong solvent effect on the spunbonded sheet material, especially polyolefin fibre sheets, to cause a swelling of the sheet fibres of at least about 1.5% at 86° F after a 5 minute immersion of the sheet material in pure solvent; the preferred solvents should cause a swelling of at least about 2 %, optimally at least about 2.5%.

Other useful solvents include certain oxygenated materials as well as nitrogen-containing compounds such as tetrahydrofuran, spirits of turpentine, Lactole spirits, pine oil, Sun spirits, propylene oxide, diisobutyl ketone, alphaterpineol, methylpropyl ketone, methylisopentyl ketone, cyclohexane, n-propyl acetate, methylethyl ketone, ethyl acetate, 2-octyl alcohol and n-decyl alcohol. Other useful solvents containing other atoms in addition to hydrogen and carbon, include: the oxygen-containing cyclic compounds, ketones, relatively high molecular weight esters, wherein the ester group contains at least 4 carbon atoms, ethers, higher molecular weight alcohols, i.e. of at least about 8 carbon atoms.

The desired information, whether it be information responding to the identification of an individual or directed to, for example, monetary amounts, can be imprinted onto the surface of the sheet of spunbonded thermoplastic polymer fibres manually, as by writing with a ballpoint pen or pencil, or by any of the conventional printing procedures, including the screen process, offset lithography, letterpress, flexography, gravure, plateless engraving (thermography), and can also be die-stamped with and without ink (cold and/or hot). Preferably however, the printing is done using the conventional offset procedure. The offset procedure is preferred for both the printing of the background and/or the treatment with solvent, as well as for the printing of the desired information, other, of course, than a signature.

If desired, the polymer fire sheet of the present invention can also be coated or laminated so as to form a twoply system. Thus, when an opaque ply is desired, the side other than that on which the information is imprinted can be, for example, laminated to a wide range of films, foils, papers, fabrics and foams, using most conventional techniques. Where laminating or coating is to be utilized, of course, the adhesive or the coating composition, respectively, should be selected so as to avoid damaging the sheet material. Such compositions for both bonding of laminates and coating are well known in the art, and by themselves form no part of the present invention.

The inks which can be utilized for the present invention, in order to increase the visibility of any abrasion of the surface of the sheet material, include not only conventional colored inks, which impart a visible coloration to the surface, but also the so-called "black light" inks which are visible only under radiation of certain wave lengths, e.g. ultraviolet. This background inking, as pointed out above, is carried out with inks which are generally considered unsuitable for these solvent-affected sheet materials. For example, for spunbonded high-density polyethylene fibre sheet material sold under the trademark TYVEK by Dupont de Nemours and Co., the Dupont publications recommend ink having not greater than 3% volatile solvents. When printing using the offset method or letter press method, where the same inks are often utilized, inks of the quick-drying type containing 27% volatile solvents are often available and these were considered definitely not recommended for TYVEK. See Dupont bulletins S-9, dated March, 1973, "The properties and Processing of TYVEK Spunbonded Olefin", and S-7, dated December, 1970, "Printing TYVEK"; Dupont Technical Information, Spunbonded Products, Textile Fibre Department, Spunbonded Products Marketing, E. I. Dupont de Nemours & Co., Inc., Wilmington, Dela.

However, in accordance with the present invention, such inks would be especially well suited for use over those areas which are to be treated to render them readily abraded. However, when printing the desired information over the treated surface, the more conventional, low solvent inks should be utilized because, as suggested by the manufacturer of TYVEK, the puckering which occurs during the printing can result in undesirable loss of register of the desired printed information.

It has been found, for example, when treating high-density polyethylene fibre sheet materials, that applying to the surface an ink containing at least about 5% of a volatile solvent normally used in the ink, to imprint a primary color over an area of the surface of the sheet, is sufficient to obtain the desired effect of easy abrasion over that area. It is also possible to obtain the desired effect when imprinting an overall shading, or tone value, of a color by utilizing a somewhat higher percentage of solvent in the ink solution. Generally, the inks which are to be used to imprint the desired information on to the treated surface can be substantially those which can be used on the untreated TYVEK.

It is preferred that only a portion of the surface of the spunbonded thermoplastic polymer fibre sheet be treated in accordance with the present invention, and specifically that portion that contains the desired non-alterable information. For example, in the case of identification cards, the information describing the individual and/or his signature, and in the case of, for example, travellers checks or identification cards for credit cards, in the area where the signature is to be placed. This tends to avoid any slight deterioration in the overall appearance of the sheet, and only that portion which includes the desired information will thus have any even slight change in appearance.

When the fibre sheet material is laminated to a heavier backing, for example, a sheet of polymer plastic material, the resulting less flexible and heavier weight product can be utilized for permanent credit card use. Further, if desired, of course, after the desired information has been printed, a clear coating or laminate can be applied over the imprinted surface.

The following examples are preferred embodiments of the present invention. They are merely illustrative of the invention, exemplifying certain aspects thereof, and are not to be taken as exclusive of the scope of the invention.

EXAMPLE 1

Sheet material, formed of spun strands of very fine, interconnected, non-coated, high-density polyethylene fibres, bonded together by heat and pressure, was printed over an area 2 inches by 4 inches at the bottom of each sheet by offset lithography, utilizing an ink having the following composition:

| Component | Percent by Weight |
|---|---|
| Flush pigment (red) | 86% |

-continued

| Component | Percent by Weight |
|---|---|
| Mineral spirits | 10% |
| Cobalt drier | 2% |
| Manganese drier | 2% |

The sheet itself has a white appearance. The contrasting color was imprinted in full primary color and permitted to dry. The area was slightly puckered and upon light rubbing with a pencil eraser, the surface was intensively abraded. On another sample of the same sheet, a signature was placed over the imprinted area, the signature was clearly visible, and when an attempt was made to erase the signature the area rapidly abraded, the abrasion being enhanced in its visibility by the contrast between the color of the ink and the color of the underlying white sheet mateial which became visible upon the abrasion of the surface.

A subsequent tst was made where an overall screen, or tone-shading, value of the above ink, was applied overall to the sheet, followed by subsequent offset lithography utilizing black ink and of a type containing less than 3% solvent. The imprinted information was clearly visible and accurately registered and an attempt to erase any of the imprinted information rapidly abraded the surface,, which abrasion was enhanced in its visibility again by the contrast between the tone-shading and the write sheet material.

The patentable embodiments of this invention which are claimed are as follows:

1. A sheet articles for providing information as in a form, card or other type document for identification or other like purposes, having at least a portion thereof sensitive to alteration comprising: a sheet of interconnected, continuous, spun strands of thermoplastic polymer fibres bonded together with heat and pressure so as to form a relatively smooth surface of a texture suitable for printing; said alteration-sensitive portion of said surface having been treated with a solvent so as to have caused swelling of the surface fibres during the treatment and to result in a surface which is rendered permanently more easily degraded by abrasion; the solvent being sufficient to provide at least about 2% selling of the fibres at 86° F after a five minute immersion of the sheet material in pure solvent; and information applied onto the treated portion of the surface; so that an attempt to erase said information will simultaneously cause a visible abrasion of at least some part of said treated portion of said surface, thereby revealing that an alteration has been made.

2. An article in accordance with claim 1, comprising in addition, an ink coating covering at least said treated portion of the surface of said sheet and having a substantially different, or contrasting, color appearance than the adjacent surrounding surface of the sheet.

3. The article in accordance with claim 2, wherein the thermoplastic fibres.

4. The article in accordance with claim 3, wherein the polyolefin is polyethylene.

5. The article in accordance with claim 1, wherein the solvent is a non-polar liquid.

6. The article in accordance with claim 5, wherein the non-polar liquid is a volatile hydrocarbon.

7. The article in accordance with claim 1, wherein the hydrocarbon has not more than about 12 carbon atoms.

8. A sheet article for providing information as in a form, card or other type document for identification or other like purposes, having at least a portion thereof sensitive to alteration comprising: a sheet of interconnected, continuous, spun strands of thermoplastic polymer fibres bonded together with heat and pressure so as to form a relatively smooth surface of a texture suitable for printing; at least said alteration-sensitive portion of the surface having been treated with a solvent for the thermoplastic polymers so as to have caused swelling of the surface fibres during the treatment and to result in a surface which is rendered permanently more easily degraded by abrasion; the solvent being sufficient to provide at least about 2% swelling of the fibres at 86° F after a five minute immersion of the sheet material in pure solvent, said solvent is selected from the group consisting of volatile hydrocaron liquids, oxyhydrocarbon ethers and ketones, esters, halogenated hydrocarbons, and alcohols having at least about eight carbon atoms, an ink coating covering at least said treated portion of the surface of said sheet, and information applied onto the treated portion of the surface; so that an attempt to erase said information will simultaneously cause a visible abrasion of at least some part of said ink coating and said treated portion of said surface, thereby revealing that an alteration has been made by the abrasion being enhanced in its visibility by the contrast between the coloring of the ink coating and the coloring of the treated portion of said sheet material.

9. The article in accordance with claim 8, wherein said ink coating is of the "black light" type which are visible only under radiation of certain wave lengths.

10. The article in accordance with claim 9 wherein said ink coating is visible under ultraviolet light.

11. A sheet article for providing information as in a form, card, or other type document, for identification or other like purposes, having at least a portion thereof sensitive to alteration comprising: a sheet of interconnected, continuous, spun strands of thermoplastic polymer fibres bonded together with heat and pressure so as to form a relatively smooth surface of a texture suitable for printing; said alteration-sensitive portion of said surface having been treated with a solvent so as to have caused swelling of the surface fibres during the treatment and to result in a surface which is rendered permanently more easily degraded by abrasion; the solvent being sufficiently strong to provide at least about 2% swelling of the fibres at 86° F after a five minute immersion of the sheet material in pure solvent, said solvent is selected from the group consisting of volatile hydrocarbon liquids, oxyhydrocarbon ethers and ketones, esters, halogenated hydrocarbons, and alcohols having at least about eight carbon atoms; and information applied onto the treated portion of the surface; so that an attempt to erase said information will simultaneously cause a visible abrasion of at least some part of said treated portion of said surface, thereby revealing that an alteration has been made.

* * * * *